US009040852B2

(12) United States Patent
Engesser et al.

(10) Patent No.: US 9,040,852 B2
(45) Date of Patent: May 26, 2015

(54) SWITCHING DEVICE FOR A SWITCHGEAR CABINET

(71) Applicants: Rainer Engesser, Büttelborn (DE); Alexander Hager, Erlangen (DE); Martin Kasseckert, Nürnberg (DE); Jürgen Kummer, Amberg (DE); Ralf Leumansik, Nürnberg (DE); Roland Theil, Nürnberg (DE)

(72) Inventors: Rainer Engesser, Büttelborn (DE); Alexander Hager, Erlangen (DE); Martin Kasseckert, Nürnberg (DE); Jürgen Kummer, Amberg (DE); Ralf Leumansik, Nürnberg (DE); Roland Theil, Nürnberg (DE)

(73) Assignee: Siemens Aktiengesellschaft, Munich (DE)

( * ) Notice: Subject to any disclaimer, the term of this patent is extended or adjusted under 35 U.S.C. 154(b) by 243 days.

(21) Appl. No.: 13/705,203

(22) Filed: Dec. 5, 2012

(65) Prior Publication Data

US 2013/0192962 A1 Aug. 1, 2013

(30) Foreign Application Priority Data

Jan. 30, 2012 (DE) ..... 10 2012 201 258

(51) Int. Cl.
*H01H 9/20* (2006.01)
*H01H 31/00* (2006.01)
*H01H 9/22* (2006.01)

(52) U.S. Cl.
CPC .. *H01H 9/20* (2013.01); *H01H 9/22* (2013.01)

(58) Field of Classification Search
USPC ..... 200/50.01–50.04, 50.12–50.16, 50.18, 200/43.14
See application file for complete search history.

(56) References Cited

U.S. PATENT DOCUMENTS

| | | | | |
|---|---|---|---|---|
| 2,218,028 | A * | 10/1940 | Heim | 200/50.15 |
| 3,179,759 | A | 4/1965 | Rice et al. | |
| 7,420,133 | B2 * | 9/2008 | Farrow et al. | 200/50.15 |
| 8,232,488 | B2 | 7/2012 | Haendler et al. | |
| 2008/0053797 | A1 | 3/2008 | Farrow et al. | |

FOREIGN PATENT DOCUMENTS

| | | | |
|---|---|---|---|
| DE | 2219241 | A1 | 10/1973 |
| DE | 19647747 | C1 | 4/1998 |

(Continued)

OTHER PUBLICATIONS

German Priority Document 102012201258.3, filed Jan. 30, 2012.

(Continued)

*Primary Examiner* — Renee Luebke
*Assistant Examiner* — Lheiren Mae A Caroc
(74) *Attorney, Agent, or Firm* — Harness, Dickey & Pierce, P.L.C.

(57) ABSTRACT

A switching device is disclosed for a switchgear cabinet including a switchgear cabinet door. The switching device includes a housing, a switching unit disposed in the housing, a handle is movable between a first and a second position for actuating the switching unit, and a locking bar that is movable between a locking position and a release position. The locking bar is linked to the handle via a coupling device such that the latter moves the locking bar to the locking position when the handle is moved to the first position and moves the locking bar to the release position when the handle is moved to the second position. A clamping device is provided for clamping the locking bar in the release position, the coupling device including at least one spring element in the force path between the handle and the locking bar.

21 Claims, 5 Drawing Sheets

(56) References Cited

FOREIGN PATENT DOCUMENTS

DE 102006054637 A1 5/2008
DE 102007024978 A1 11/2008
DE 102008016361 B3 4/2009

OTHER PUBLICATIONS

German Office Action for German Application No. 102012201258.3 dated Oct. 9, 2012.

* cited by examiner

SWITCHING DEVICE FOR A SWITCHGEAR CABINET

PRIORITY STATEMENT

The present application hereby claims priority under 35 U.S.C. §119 to German patent application number DE 10 2012 201 258.3 filed Jan. 30, 2012, the entire contents of which are hereby incorporated herein by reference.

FIELD

At least one embodiment of the present invention generally relates to a switching device for a switchgear cabinet having a switchgear cabinet door, to a switchgear cabinet of this kind, and to a method for deactivating at least one safety function of a switching device for a switchgear cabinet having a switchgear cabinet door.

BACKGROUND

The principle of switching devices for switchgear cabinets is well known. They are used, for example, to act as main switches for equipment whose components are accommodated in such a switchgear cabinet. Thus, in addition to the switching device, e.g. as main switch, other electrical and electronic components such as safety switches, circuit breakers or programmable components may be provided in the switchgear cabinet.

Such a switchgear cabinet is usually disposed in the vicinity of a machine that is controlled by the electronic inner workings of the switchgear cabinet. In order to operate or more specifically start up the machine, the switching device must change from an off-state to an on-state. For this purpose, known switching devices have a handle, also known as an operating mechanism or more specifically a rotary operating mechanism, which can be moved at least between a first and a second position.

In order to ensure that no electrical operating accidents occur during operation of equipment using such a switching device or rather such a switchgear cabinet, safety functions are provided. Thus in the case of known switching devices, for example, locking bars are present which are actuated by the handle when the installation is switched on.

If the handle is moved from a second position to a first position, i.e. from an off-position to an on-position, the locking bar is simultaneously moved from a release position to a locking position. A locking position is to be understood as meaning a position in which the locking bar is in engagement with the switchgear cabinet door or a locking bar component connected to the switchgear cabinet door, so that with the locking bar in this locking position the switchgear cabinet door is locked against opening. In other words, once the installation has been switched on via the handle of the switching device, the switchgear cabinet door can no longer be opened. Therefore, while the installation is switched on it is ensured that it is impossible to access the interior of the switchgear cabinet with the handle of the switching device in the on-position.

The disadvantage of known switching devices is that locking bar protection of this kind may be undesirable depending on the requirements and installed equipment situation. This is the case, for example, if a large number of switching devices are installed in a switchgear cabinet which is used, for example, for a large scale installations. It can also be disadvantageous if access to the interior of the switchgear cabinet is necessary during machine maintenance even though the installation is in operation, i.e. the handle is "on" in the first position.

For both cases, in known switching devices, a separate design must be provided which has no such locking bar or rather no such locking device. This results in increased manufacturing complexity on the one hand and increased storage costs on the other. The production costs also increase, as having two different variants means producing smaller quantities of each variant. Another disadvantage is that the deployment flexibility of each switching device is limited to the respective variant.

SUMMARY

At least one embodiment of the present invention is directed to at least partially eliminating at least one of the above described disadvantages of known switching devices. At least one embodiment of the present invention provides a switching device for a switchgear cabinet, a switchgear cabinet having a switchgear cabinet door for sealing a switchgear cabinet and at least one embodiment provides a method for deactivating at least one safety function of a switching device for a switchgear cabinet which simply and inexpensively provide a switching device having a deactivatable safety function.

A switching device for a switchgear cabinet is disclosed, a switchgear cabinet having a switchgear cabinet door is disclosed, and a method for deactivating at least one safety function of a switching device for a switchgear cabinet is disclosed. Further features and details of the invention will emerge from the sub-claims, the description and the drawings. Features and details described in connection with at least one embodiment of the inventive switching device obviously also apply in relation to at least one embodiment of the inventive method and at least one embodiment of the inventive switchgear cabinet and vice versa in each case so that, in respect of disclosure, reference is always made or may always be made reciprocally to the individual aspects of the invention.

An inventive switching device for a switchgear cabinet of at least one embodiment includes a switchgear cabinet door and comprises a housing. Disposed in the housing is a switching unit used for switching the switching device on and off. The switching unit can be operated by a handle which can be moved between a first and a second position. The can also be understood as actuating the switching unit. The handle is in particular an operating mechanism or more precisely a rotary operating mechanism of the switching device for actuating the switching unit.

BRIEF DESCRIPTION OF THE DRAWINGS

The present invention will now be explained in greater detail with reference to the accompanying drawings. The terms "left", "right", "top" and "bottom" relate to an orientation of the drawings with normally readable reference characters. In the schematic drawings.

Elements of identical function and mode of operation are provided with the same reference characters in all the figures.

DETAILED DESCRIPTION OF THE EXAMPLE EMBODIMENTS

Figure 1:
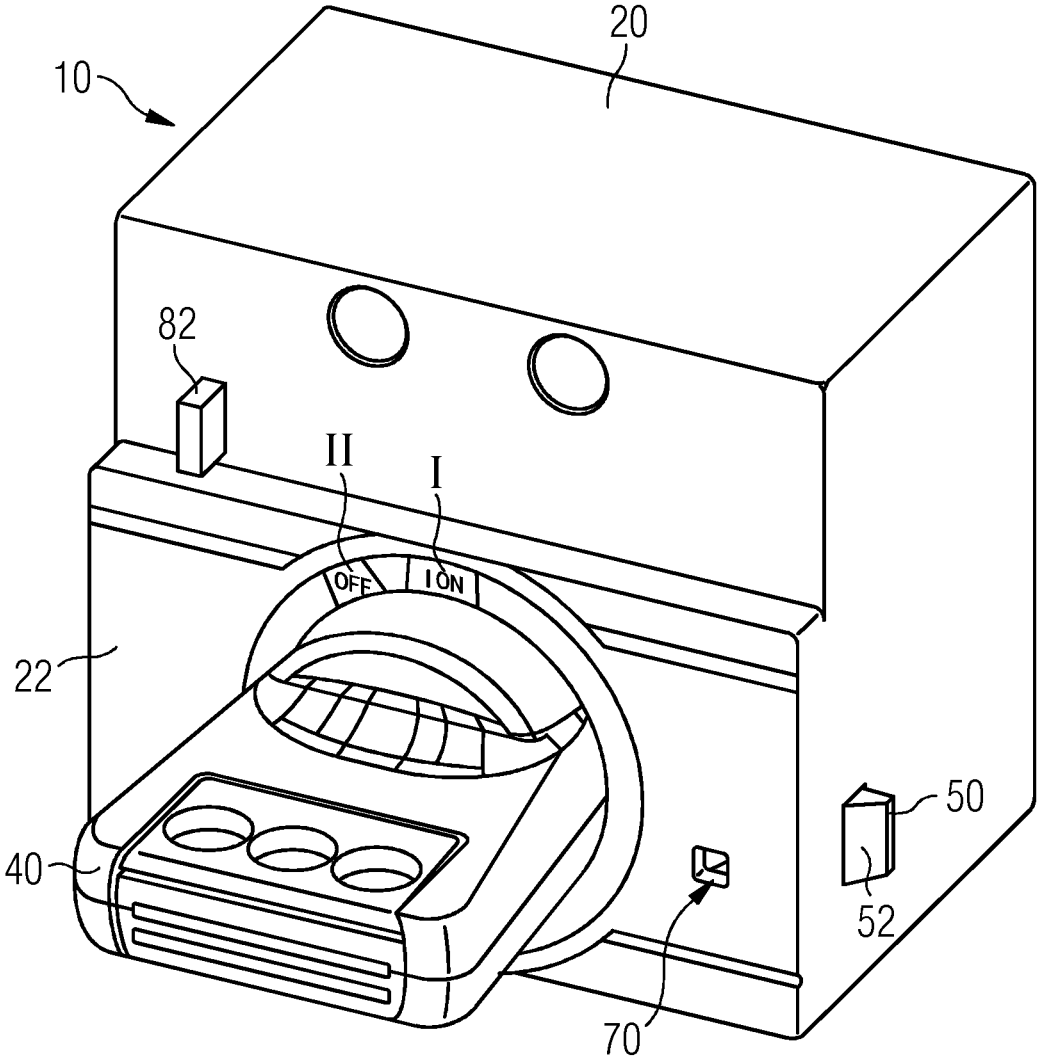
FIG. 1 shows a perspective view of an embodiment of a switching device.

The present invention will be further described in detail in conjunction with the accompanying drawings and embodiments. It should be understood that the particular embodiments described herein are only used to illustrate the present invention but not to limit the present invention.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

Also provided in at least one embodiment is a locking bar that can be moved between a locking position and a release position and which is linked to the handle via a coupling device. The linkage is such that, when the handle is moved to the first position, the coupling device moves the locking bar to the locking position and, when the handle is moved to the second position, it moves the locking bar to the release position. The two positions of the handle are to be understood as meaning that the first position corresponds, for example, to an on-position of the switching unit. The second position can be, for example, the off-position of the switching unit. If the handle is therefore rotated to the first position, the switching unit is ON, whereas if the handle is rotated to the second position the switching unit is OFF. The same self-evidently applies to the other connected components, in particular to a connected machine.

A locking position and a release position of the locking bar are to be understood as a correlation with the switchgear cabinet door of the switchgear cabinet. The locking bar is preferably moved between these two positions by changing a relationship with respect to the housing of the switching device. Thus, the locking bar can be disposed at least partly inside the housing when it is in the release position. It then preferably moves at least partially out of the housing of the switching device in order to assume the locking position. This movement is preferably a translatory motion. In the locking position, the locking bar can engage to a corresponding depth in the switchgear cabinet door or a locking component of the switchgear cabinet door, thus interlocking the switchgear cabinet door and the switching device. As the switching device is usually likewise mounted inside the switchgear cabinet by means of screws, for example, the switchgear cabinet door is therefore interlocked in this locked position. Said locked position preferably corresponds to the closed or essentially closed switchgear cabinet door. In the release position, this engagement between the locking bar and the switchgear cabinet door or rather a locking element of the switchgear cabinet door is removed again, so that the switchgear cabinet door can be opened.

If the switchgear cabinet door is closed and the handle for operating the switching unit is then moved from the second position to the first position, e.g. through an opening or via gearing mechanisms, the correspondingly connected machine is switched on. The locking bar simultaneously moves from the release position to the locking position so that the switchgear cabinet door is locked in the closed position at the same time as the switch-on.

A switching device according to at least one embodiment of the invention includes a clamping device that is provided for clamping the locking bar in the release position. The coupling device also has at least one spring element in the force path between the handle and the locking bar. The force path between the handle and the locking bar is to be understood as meaning that the force for moving the locking bar between the release position and the locking position is transmitted along said force path. This can take place, for example, via gearing components, in the simplest case via a gear rod.

In a switching device according to at least one embodiment of the invention, a spring element is disposed within this force path. The spring element can be a compression spring, for example. However, other spring elements such as a tension spring, a torsion spring or elastomer components are also possible as a spring element. Combinations of different types of spring are also conceivable within the scope of the present invention.

The clamping device for clamping the locking bar can be implemented in many different ways. A friction fit and/or a form fit can be provided particularly simply between the clamping device and the locking bar. Thus, for example, a clamping screw can press against the locking bar or rather a corresponding clamping recess in the locking bar, so that in the event of correlation and insertion of the clamping device into such a recess, the locking bar is no longer movable. For example, the locking bar is first pushed into the release position. This can be done manually, for example. It is also possible for the locking bar to be already in the release position, as the handle is in the second position. As soon as the locking bar is disposed in the release position, the clamping device can effect clamping of the locking bar in this release position.

The advantage of at least one embodiment of the inventive design is that, through the application of the clamping device, the locking bar is locked, i.e. fixed, in the release position. Even if the handle now moves to the first position in order to switch on a connected machine, for example, the coupling device will basically only convert the corresponding movement into a deformation of the spring element. As the locking bar is locked or more specifically clamped in the release position, the locking bar can no longer move as a result of the movement of the handle. The locking bar accordingly remains in the release position irrespective of whether the handle is in the first or second position. The movement of the handle between the two positions in this case only changes the force stored in the spring element and no longer results in movement of the locking bar.

Therefore, with a switching device according to at least one embodiment of the invention in situ, i.e. if the switching device is installed in a switchgear cabinet, it can be decided which design variant is necessary. Also in the case of maintenance of an already installed switching device, the safety function provided by the locking bar can be, so to speak, deactivated or more precisely circumvented via the clamping device. An identical switching device design can therefore be used for both variants, i.e. with and without locking bar device. In addition, simple circumventing of the safety function is possible in situ via the clamping device. Self-evidently, the clamping device can be disposed and/or implemented such that it cannot be simply moved to the clamping position for clamping the locking bar in the release position, but preferably only with the aid of a special tool, in particular by a qualified technician.

In the case of a switching device according to at least one embodiment of the invention, the handle is preferably a rotary switch. It can also be termed a diverter switch which, as an articulated-shaft mechanism, converts the rotation of the handle into a translatory movement for actuating the switching unit and/or into a translatory movement for moving the locking bar between the release position and the locking position.

It can be advantageous in the case of a switching device according to at least one embodiment of the invention if the spring element is implemented such that it allows the handle to move to the first position against the spring force of the spring element when the locking bar is clamped in the release position. As already described in the preceding paragraph, the spring element is therefore preferably disposed in the force path such that it can absorb the transmission force for moving the locking bar between the two positions. As a secondary result to the actuation of the switching unit, movement of the handle causes the movement force to be stored in the spring. The corresponding latching mechanisms for the two positions of the handle are preferably implemented such that they also resist an increased spring force so that it is ensured that the spring force of the spring element does not push the handle back to the second position when the clamping device clamps the locking bar in the release position. In particular, the spring element is here disposed such that the direction of force of the spring element is identical or essentially identical to the force transmission for the translatory movement of the locking bar between the locking position and the release position.

Another advantage can then be achieved in the case of a switching device according to at least one embodiment of the invention if the spring element applies a force to the locking bar in the direction of the locking position when the handle is in the second position. The handle in the second position preferably means that the switching unit and therefore, for example, a connected machine are OFF. This application of force therefore more closely defines the direction of force of the spring element. However, this does not necessarily mean that the locking bar must be in the locking position if the handle is disposed in the second position. Rather, the locking bar can remain in the release position as long as the handle is in the second position. However, the spring force of the spring element will act in the direction of the locking position, so that when the handle is moved to the first position, the spring force increases if the clamping device is activated or remains the same if the clamping device is deactivated, and in this way moves the locking bar to the locking position with the spring force remaining essentially constant.

It is also possible, in the second position of the handle, for the locking bar to be already in the locking position, thereby providing, so to speak, a snap-lock catch whereby, despite the machine being OFF, the locking bar is in the locking position when the handle is therefore in the second position. If the door is closed in such a case, door locking is carried out despite the machine being OFF, as the locking bar is briefly moved to the release position for closing the door before being latched again in the locking position. In order to perform clamping in the release position by the clamping device, in this embodiment it is not sufficient to only move the handle to the second position. Rather, the locking bar must be actively pushed to the release position, e.g. manually or using a tool, in order to increase the spring force in the spring element and then activate the clamping device in this position, i.e. clamp the locking bar in the release position.

It can also be advantageous if, in the case of a switching device according to at least one embodiment of the invention, the locking bar can be in particular reversibly and/or temporarily clamped in the release position via the clamping device using a tool. Reversible clamping is to be understood as meaning that the clamping can be produced and released again using a clamping screw, for example. Thus one and the same switching device can be used in different situations. Particularly in the case of lengthy maintenance work, long-term reversible circumventing of the locking bar can be carried out. Temporary clamping is preferably to be understood as meaning that one-off circumventing of the safety function is carried out. Temporary clamping can also be said to be active as long as the tool is in the clamping position. Clamping is preferably reversible if the clamping remains in force even when the tool is removed. In such a case, however, clamping can be removed again. Self-evidently, irreversible clamping, e.g. using snap-locking means, is also possible within the scope of the present invention. It can therefore be ensured that a configuration once made, without the safety function, always remains irreversible in this variant of the switching device.

A further advantage is achieved in that the handle in the case of a switching device according to at least one embodiment of the invention is rotatable between the first and the second position and the locking bar is designed for a translatory movement between the locking position and the release position. The coupling device is here designed to convert the rotational movement of the handle into a translatory movement of the locking bar, thereby enabling particularly compact variants of the switching device to be achieved. The coupling device can therefore also be termed an angle or conversion gearing mechanism or contain such a mechanism. The coupling device is in particular a secondary gearing mechanism, so that a corresponding primary angle or conversion gearing mechanism can also be implemented for actuating the switching unit in a translatory manner.

It is also advantageous if, in the case of a switching device according to at least one embodiment of the invention, the locking bar has at least one locking bevel via which the switchgear cabinet door can be moved to the release position against the force of the spring element irrespective of the position of the handle when the locking bar is closed. Said locking bevel facilitates locking. Particularly in the case of a locking bar which is always in the locking position, the locking bar can be pushed to the release position against the spring force of the spring element when the switchgear cabinet door is closed against the locking bevel. This enables the switchgear cabinet door to be latched in position regardless of the respective positioning of the handle.

It is likewise advantageous if, in the case of a switching device according to at least one embodiment of the invention, at least one interrogation device is provided which is designed to prevent the handle from moving to the first position when the cabinet door is open. The interrogation device can also be termed an interrogation safety function, i.e. an additional safety function. It is used to ensure that the switching unit can only be switched on if the door is already closed. In correlation with the embodiments of the present invention, dual protection can therefore be achieved. Switch-on is only possible when the door is closed. In the event of switch-on when the door is closed, the door is locked in the switched-on situation. These two safety functions therefore preferably complement one another.

It is advantageous if, in the case of a switching device according to at least one embodiment of the invention, the interrogation device has an interrogation locking bar that can be moved between a door-closed position and a door-open position. Force is applied thereto by a spring device in the direction of a door-open position and is designed to prevent movement of the handle in the door-open position and to allow movement of the handle in the door-closed position. This design ensures, for example, a form fit and/or friction fit between a component of the interrogation device and a component of the handle when the interrogation locking bar is in the door-open position. This can take place, for example, via lugs which prevent the handle from turning. The spring device is preferably braced against the housing and is e.g. a compression spring. Self-evidently, other springs such as torsion spring or tension springs are also conceivable within the scope of at least one embodiment of the present invention.

A switching device according to at least one embodiment of the invention can be further developed in that at least one clamping device can be provided for clamping the interrogation locking bar in the door-closed position. The clamping device is used for activating and deactivating the interrogation safety function. For positioning of the interrogation locking bar in the door-closed position, clamping in this position can take place in a manner already described in connection with the locking bar for the main safety function. The switching device can therefore likewise be varied irreversibly, reversibly and/or temporarily such that circumvention or more precisely deactivation of the interrogation safety function takes place.

It is likewise advantageous if, in the case of a switching device according to at least one embodiment of the invention, the at least one clamping device and the clamping device are of identical or essentially identical design, in particular can be clamped using the same tool. Such a tool can be, for example, a screwdriver, in particular for Phillips and/or slotted-head screws, thereby simplifying assembly of a switching device according to at least one embodiment of the invention, as the circumvention of the two separate safety functions takes place in the same process steps and the same tool can be used for this purpose. Also the complexity of the tool can be reduced, as the same tool as that required for mounting the switching device in the switchgear cabinet can preferably be used.

It is also advantageous if, in the case of a switching device according to at least one embodiment of the invention, the clamping device and/or the clamping devices include at least one clamping screw. The provision of such clamping screws, i.e. the use of correlating threads, provides the inventive clamping in a particularly simple and inexpensive manner.

Another advantage is achieved in that, in the case of a switching device according to at least one embodiment of the invention, the clamping device and/or the clamping devices are accessible from outside the housing. Thus, without additional assembly steps, the desired activation/deactivation/circumvention of the respective safety function can be carried out directly. This saves time for the corresponding assembly or maintenance operation.

Alternatively, it is possible in the case of a switching device according to at least one embodiment of the invention for the clamping device and/or the clamping devices to be accessible only after opening of the housing, in particular of a housing cover. This can be useful if the safety function is always required. It can then only be deactivated if such a housing cover is removed i.e. opened by a trained technician so as to provide access to the clamping device and/or clamping devices. This ensures that unauthorized i.e. untrained personnel cannot disable the safety functions.

Another subject matter of at least one embodiment of the invention is a switchgear cabinet having a switchgear cabinet door for sealing the switchgear cabinet. Such a switchgear cabinet is characterized in that at least one switching device according to at least one embodiment of the present invention is used. The switching device can be used, for example, as a main switch for the components in the switchgear cabinet or more specifically for a connected machine. The handle of the switchgear cabinet preferably extends through an opening in the switchgear cabinet door and can therefore be actuated from outside the switchgear cabinet without having to open the door. Through the use of a switching device according to at least one embodiment of the invention, the same advantages are achieved as have already been explained in detail with reference to such a switching device according to at least one embodiment of the invention.

Another subject matter of at least one embodiment of the present invention is a method for deactivating at least one safety function of a switching device for a switchgear cabinet having a switchgear cabinet door. The method of at least one embodiment is characterized in that a locking bar and/or an interrogation unit can be clamped in a release position and/or a door-closed position by a clamping device and/or clamping devices. The safety function is therefore a protection of the door in the closed state or rather an interrogation safety function.

Both safety functions can be jointly activated or deactivated by a method according to at least one embodiment of the invention. This makes it possible, e.g. when installing a safety device, to decide which variant is desirable or necessary. If it is required that the safety function for locking the door is to be switched off or deactivated, the locking bar is moved to the release position. In this release position the clamping device is activated so that the locking bar is clamped in the release position, thereby deactivating said safety function. In the same way, the interrogation locking bar can also be moved to the door-closed position or be in this position, so that the clamping means is then activated, i.e. clamped, thereby clamping the interrogation locking bar in the door-closed position so that this interrogation safety function is likewise or alternatively deactivated.

At least one embodiment of the inventive method can be characterized in that it is preferably used for a switching device according to at least one embodiment of the invention or for a switchgear cabinet according to the invention. Therefore, the same advantages can be achieved as have been described in detail with reference to a switching device according to at least one embodiment of the invention or with reference to a switchgear cabinet according to at least one embodiment of the invention.

In general, in the invention the handle can be an operating mechanism or more precisely a rotary operating mechanism for actuating the switching unit.

Figure 2:
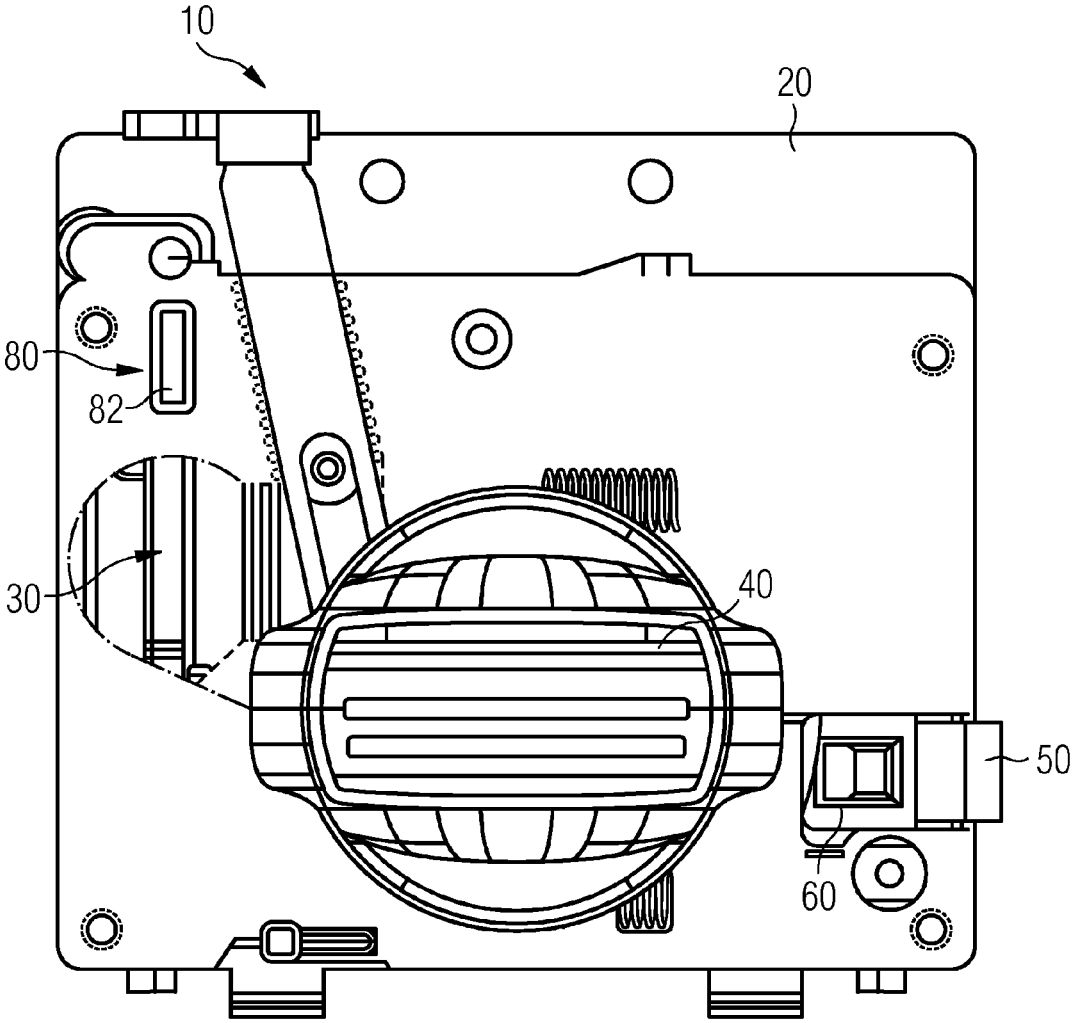
FIG. 2 shows the switching device from FIG. 1 without housing.
Figure 3:
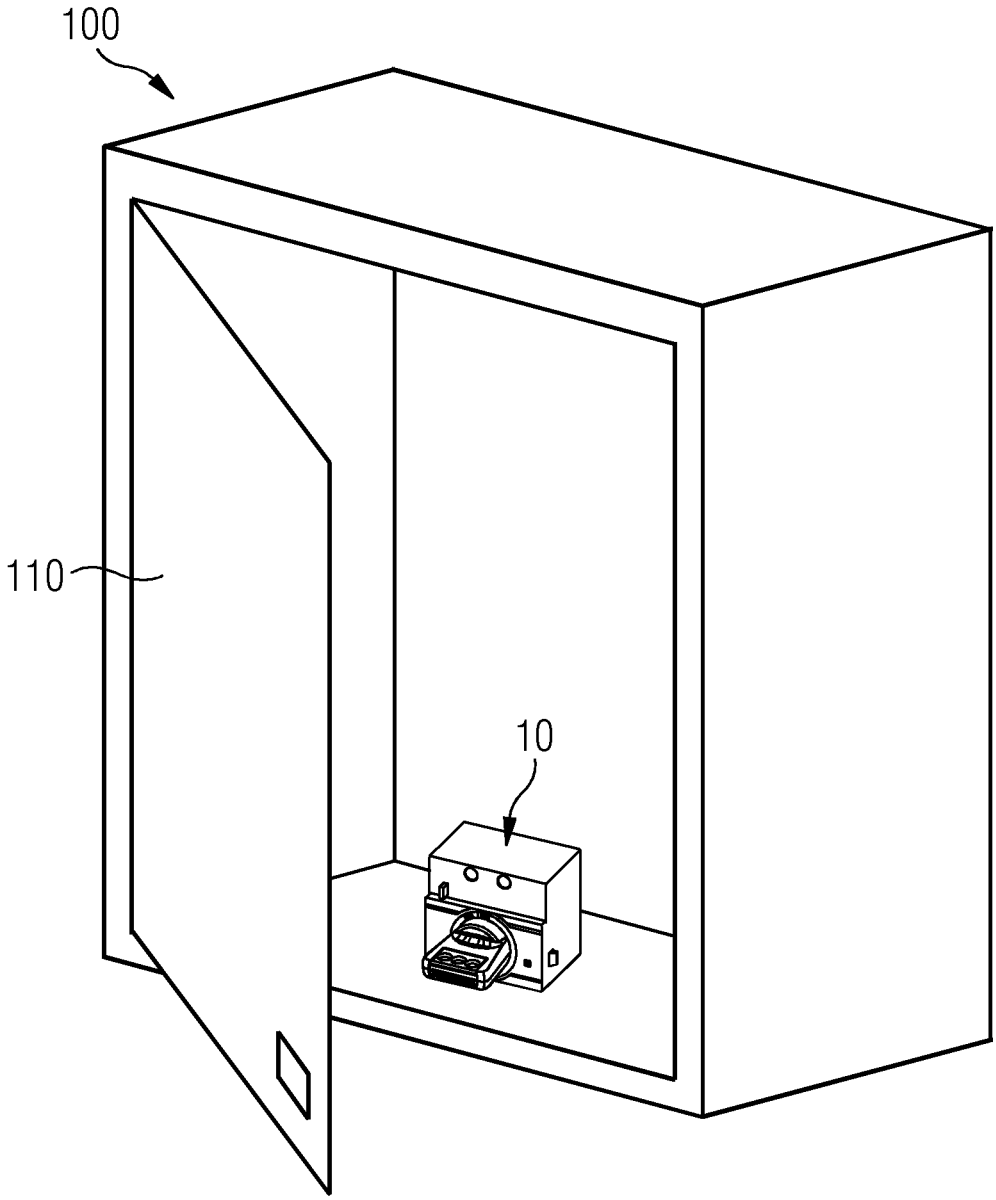
FIG. 3 shows an embodiment of a switchgear cabinet according to an embodiment of the invention.

FIGS. 1 and 2 schematically illustrate a first embodiment of a switching device 10 according to the invention. FIG. 1 is a perspective view showing that the switching device 10 has a housing 20. Disposed inside said housing 20, visible in particular through the cutout in FIG. 2, is a switching unit 30. The switching unit 30 is used, for example, for switching other components on and off, in particular switchgear.

The switching device 10 has a handle 40 which is implemented as a rotary knob. It can be moved or more precisely rotated between a first position I, an on-position, and a second position II, an off-position.

A locking bar 50 can be seen at the bottom right-hand side of the housing 20. Said locking bar 50 has a locking bevel 52 designed to facilitate latching of a switchgear cabinet door 110.

The design of the locking bar 50 will be explained in greater detail with reference to FIGS. 4*a* to 4*d*. Thus, such a locking bar 50 can be moved back and forth between a locking position S and a release position F. This movement is preferably a translation. In addition, the locking bar 50 is linked to the handle 40 via a coupling device 60. With reference to the embodiment in FIGS. 1 and 2, the rotational movement of the handle 40 is simultaneously converted into a translatory movement of the locking bar 50. A spring element 62 is disposed in the force path between the handle 40 and the locking bar 50.

Figure 4A:
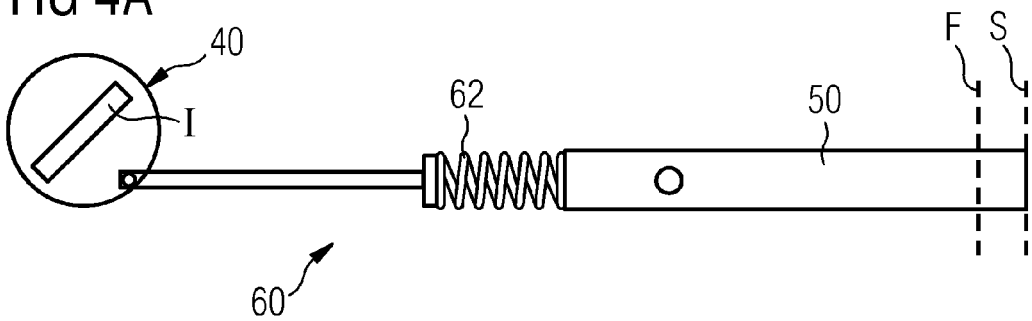
FIG. 4*a* shows a coupling device having a locking bar in locking position.

If the handle 40 is in the first position I, the locking bar 50 has been moved to the locking position S, as shown in FIG. 4*a*. If the handle 40 is in the second position II, see FIG. 4*b*, the locking bar 50 is in the release position F. In order to ensure that a variant in which this safety function of the locking bar 50 is not required can be implemented, a clamping device 70 is provided. This is designed as a clamping screw which engages in a recess in the locking bar 50. The engagement takes place when the locking bar 50 is in the release position F. If, as shown in FIG. 4*c*, the handle 40 is moved to the first position 40, the movement force is only converted for storage in the spring element 62. The locking bar 50 does not move, due to the clamping by the clamping device 70. This safety function is therefore deactivated and the locking bar 50 cannot be moved by the handle 40 from the release position F to the locking position S.

Figure 4B:
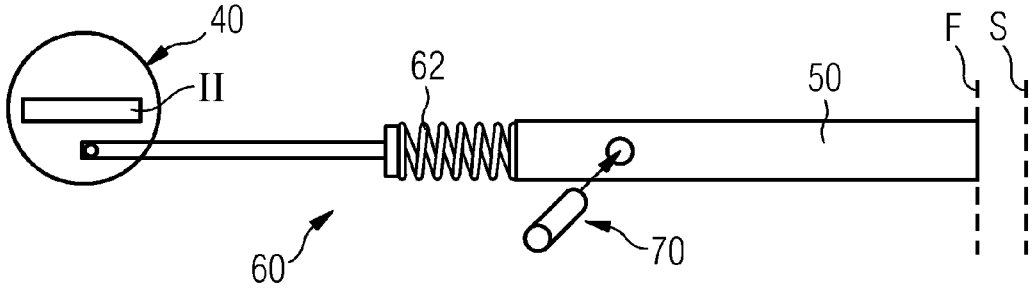
FIG. 4*b* shows a coupling device having the locking bar in release position with clamping device indicated.
Figure 4C:
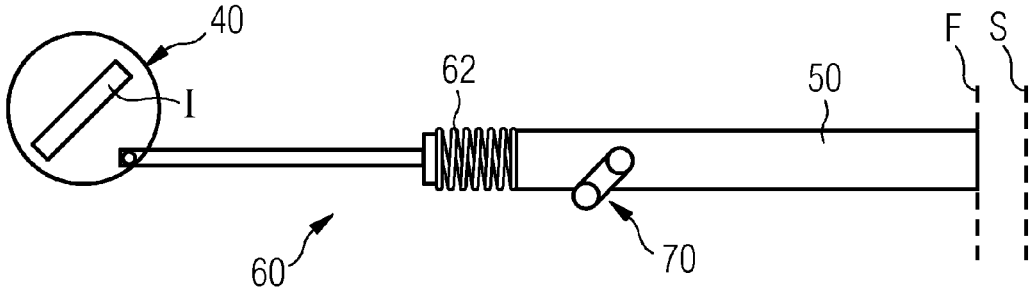
FIG. 4*c* shows a coupling device with activated clamping device with the handle in first position.
Figure 4D:
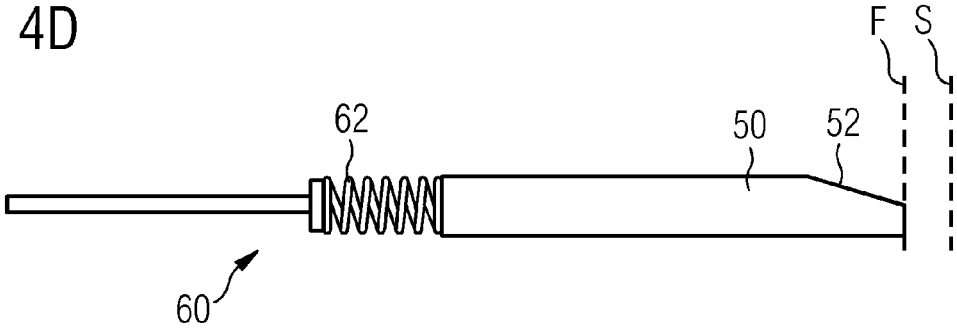
FIG. 4*d* shows a side view of the embodiment of the coupling device from FIGS. 4*a* to 4*c*.

FIG. 4*d* shows a side view of the locking bar from FIGS. 4*a* to 4*c*. Clearly visible here is a locking bevel 52 via which the switchgear cabinet door 110 can also be locked when the locking bar 50 is in the locking position S.

Figure 5A:
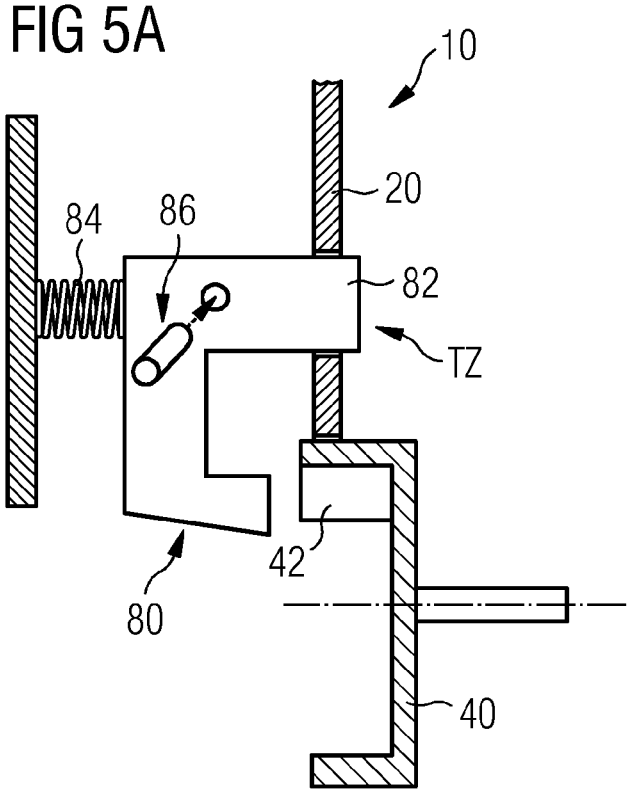
FIG. 5*a* shows an interrogation device in door-closed position and FIG. 5*b* the interrogation device from FIG. 5*a* in door-open position.
Figure 5B:
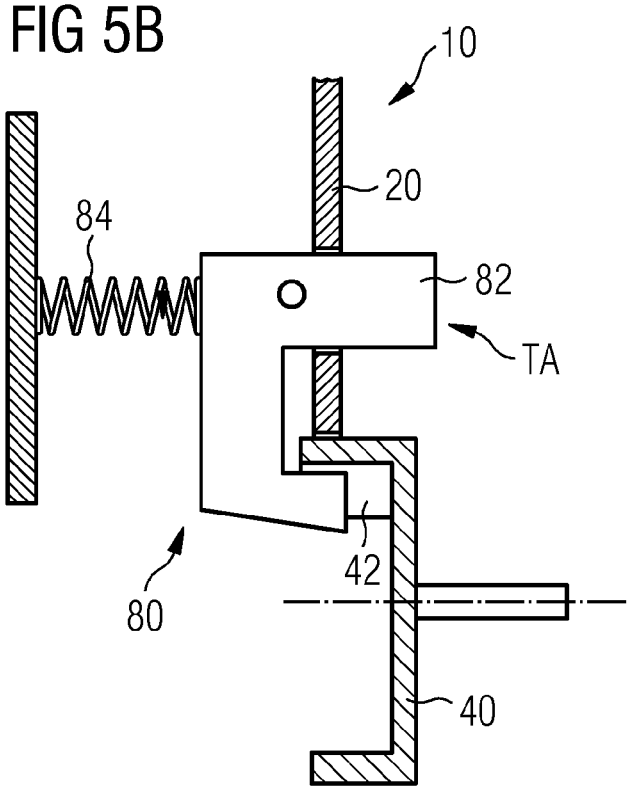

The embodiment of the switching device 10 according to FIGS. 1 and 2 also has an interrogation device 80. This is implemented, for example, as shown in greater detail in FIGS. 5*a* and 5*b*. The interrogation device 80 has for this purpose an interrogation locking bar 82. Said interrogation locking bar 82 can be displaced between a door-closed position TZ and a door-open position TA. The displacement or movement takes place against the spring force of a spring device 84. If the door is closed, it presses on the interrogation locking bar 82 and displaces it against the spring force of the spring means 84 to the door-closed position TZ.

It should also be noted that, in the door-open position TA of the interrogation locking bar 82, a lug 42 of the handle 40 is in engagement with a section of the interrogation locking bar 82. The engagement of the lug 42 prevents turning of the handle 40, in particular to the first position I. Only when the interrogation locking bar 82 has been moved to the door-closed position TZ can switch-on by the handle 40 take place.

The interrogation device 80 can also be deactivated using a clamping device 86. This engages in a similar or identical manner, e.g. using a clamping screw, in a recess in the interrogation locking bar 82, as shown schematically in FIG. 5*a*. The interrogation locking bar 82 can therefore be locked in the door-closed position TZ, so that free switching between the first position I and the second position II using the handle 40 is possible irrespective of the actual opening situation of the switchgear cabinet door 110.

The above explanation of the embodiments only describes the present invention by way of examples. Self-evidently, individual features of the embodiments, where technically feasible, may be freely combined with one another without departing from the scope of the present invention.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims.

Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, tangible computer readable medium and tangible computer program product. For example, of the aforementioned methods may be embodied in the form of a system or device, including, but not limited to, any of the structure for performing the methodology illustrated in the drawings.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

LIST OF REFERENCE CHARACTERS

10 switching device
20 housing
22 housing cover
30 switching unit
40 handle
42 lug
50 locking bar
52 locking bevel
60 coupling device
62 spring element
70 clamping device
80 interrogation device
82 interrogation locking bar
84 spring device
86 clamping device
100 switchgear cabinet
110 switchgear cabinet door
I first position of handle
II second position of handle
F release position of locking bar
S locking position of locking bar
TZ door-closed position
TA door-open position

What is claimed is:

1. A switching device for a switchgear cabinet including a switchgear cabinet door, comprising:

a housing;

a switching unit disposed in the housing;

a handle, movable between a first and a second position, for actuating the switching unit;

a locking bar, movable between a locking position and a release position, the locking bar being linked to the handle via a coupling device such that the coupling device is able to move the locking bar to the locking position when the handle is moved to the first position and is able to move the locking bar to the release position when the handle is moved to the second position; and a clamping device, configured to clamp the locking bar in the release position, wherein the coupling device includes at least one spring element in the force path between the handle and the locking bar, wherein the handle is designed to rotate between the first and the second position, and wherein the locking bar is designed for a translators movement between the locking position and the release position, wherein the coupling device is designed to convert the rotary movement of the handle into a translatory movement of the locking bar.

2. The switching device of claim 1, wherein the spring element is designed to allow the handle to be moved to the first position against the spring force of the spring element when the locking bar is clamped in the release position.

3. The switching device of claim 1, wherein the spring element is configured to exert a force on the locking bar in the direction of the locking position when the handle is in the second position.

4. The switching device of claim 1, wherein the locking bar is at least one of reversibly and temporarily clamped in the release position via the clamping device by way of a tool.

5. The switching device of claim 1, wherein the locking bar includes at least one locking bevel via which the switchgear cabinet door is movable against the force of the spring element to the release position when the locking bar is closed, irrespective of the position of the handle.

6. The switching device of claim 1, wherein at least one interrogation device is provided which is designed to prevent the handle from moving to the first position when the cabinet door is open.

7. A switchgear cabinet, comprising:

a switchgear cabinet door for sealing the switchgear cabinet; and a switching device of claim 1.

8. A method for deactivating at least one safety function of the switching device of claim 1 for the switchgear cabinet including the switchgear cabinet door, the method comprising:

clamping at least one of a locking bar and an interrogation locking bar in at least one of a release position and a door-closed position using the clamping device.

9. The switching device of claim 1, wherein the clamping device is accessible from outside the housing.

10. The switching device of claim 1, wherein the clamping device is only accessible after opening or dismantling the housing.

11. A switching device for a switchgear cabinet including a switchgear cabinet door, comprising:

a housing;

a switching unit disposed in the housing;

a handle, movable between a first and a second position, for actuating the switching unit;

a locking bar, movable between a locking position and a release position, the locking bar being linked to the handle via a coupling device such that the coupling device is able to move the locking bar to the locking position when the handle is moved to the first position and is able to move the locking bar to the release position when the handle is moved to the second position; and a clamping device, configured to clamp the locking bar in the release position, wherein the coupling device includes at least one spring element in the force path between the handle and the locking bar, wherein at least one interrogation device is provided which is designed to prevent the handle from moving to the first position when the cabinet door is open and wherein the interrogation device includes an interrogation locking bar which is movable between a door-closed position and a door-open position and to which force is applied by a spring device in the direction of the door-open position and which is designed to prevent movement of the handle in the door-open position and to allow movement of the handle in the door-closed position.

12. The switching device of claim 11, wherein at least one other clamping device is provided for clamping the interrogation locking bar in the door-closed position.

13. The switching device of claim 12, wherein the at least one other clamping device and the clamping device are of identical or essentially identical design.

14. The switching device of claim 13, wherein the at least one clamping device and another clamping device are clampable using the same tool.

15. The switching device of claim 13, wherein at least one of the clamping device and the other clamping device includes at least one clamping screw.

16. The switching device of claim 13, wherein at least one of the clamping device and the other clamping device is accessible from outside the housing.

17. The switching device of claim 13, wherein at least one of the clamping device and the other clamping device is only accessible after opening or dismantling the housing.

18. The switching device of claim 12, wherein at least one of the clamping device and the other clamping device includes at least one clamping screw.

19. The switching device of claim 12, wherein at least one of the clamping device and the other clamping device is accessible from outside the housing.

20. The switching device of claim 12, wherein at least one of the clamping device and the other clamping device is only accessible after opening or dismantling the housing.

21. A switching device for a switchgear cabinet including a switchgear cabinet door, comprising:

a housing;

a switching unit disposed in the housing;

a handle, movable between a first and a second position, for actuating the switching unit;

a locking bar, movable between a locking position and a release position, the locking bar being linked to the handle via a coupling device such that the coupling device is able to move the locking bar to the locking position when the handle is moved to the first position and is able to move the locking bar to the release position when the handle is moved to the second position; and a clamping device, configured to clamp the locking bar in the release position, wherein the coupling device includes at least one spring element in the force path between the handle and the locking bar, wherein the clamping device includes at least one clamping screw.

* * * * *